US006645036B1

(12) United States Patent
Lund et al.

(10) Patent No.: US 6,645,036 B1
(45) Date of Patent: Nov. 11, 2003

(54) WALKING TOY FIGURE

(75) Inventors: Bruce D. Lund, Chicago, IL (US); Michael Starrick, Maywood, IL (US); Krishnan Srirangam, Chicago, IL (US); Sunil William Moothedath, Chicago, IL (US)

(73) Assignee: Lund and Company Invention, L.L.C., Chicago, IL (US)

( * ) Notice: Subject to any disclaimer, the term of this patent is extended or adjusted under 35 U.S.C. 154(b) by 0 days.

(21) Appl. No.: 10/349,268

(22) Filed: Jan. 22, 2003

(51) Int. Cl.[7] ..... A63H 7/00

(52) U.S. Cl. ..... 446/355; 446/298; 446/353; 446/354

(58) Field of Search ..... 446/297, 298, 446/303, 330, 333–336, 352–356, 376, 377, 390

(56) References Cited

U.S. PATENT DOCUMENTS 4,073,088 A * 2/1978 Beny et al. ..... 446/354
4,312,150 A * 1/1982 Terzian ..... 446/354
4,349,987 A * 9/1982 Bart ..... 446/355
4,355,482 A * 10/1982 Sapkus et al. ..... 446/279
4,846,752 A * 7/1989 Combs ..... 446/279
5,045,015 A * 9/1991 Arad et al. ..... 446/355
5,159,988 A * 11/1992 Gomi et al. ..... 180/8.6
6,506,095 B1 * 1/2003 Lund et al. ..... 446/353

FOREIGN PATENT DOCUMENTS

GB 2045625 A * 11/1980 ..... A63H/3/22

* cited by examiner

*Primary Examiner*—Jacob K. Ackun
*Assistant Examiner*—Bena B. Miller

(57) ABSTRACT

The present invention includes a toy figure having a torso connected to a first leg and a second leg. A first motor is secured in the torso and is in communication with a first gear train, which is meshed to a fastener in the first leg, such that when the figure is in a standing position, the first motor causes the torso to move in relation to the first leg. A second motor is secured in the second leg and is in communication with a second gear train, which is rotatably attached to the torso such that when the figure is in the standing position, the second motor causes the second leg to move in relation to the first leg along the axis. A circuit board has pre-programmed instructions that when the figure is in the standing position controls the motors such that the figure walks across the surface.

12 Claims, 5 Drawing Sheets

WALKING TOY FIGURE

BACKGROUND OF THE INVENTION

Toy figures have always been the mainstay as a toy for young children. There exist figures that walk, crawl, and speak in response to a child touching or squeezing various parts of the figure. However, there are always a continual need for new and novel features.

SUMMARY IF THE INVENTION

There is herein described and illustrated a unique animated figure that walks, runs, and emits sound in response to interaction with a user. The figure has a plush skin that covers a housing that houses gearboxes, circuitry, batteries and various other components. The housing is divided into an upper torso and lower legs, which move relative to the torso and relative to each other about an axis. There are two motors that separately drive a gear box and which are controlled by a circuit board. The circuit board synchronizes the movement of the figure with appropriate phrases that are fed to a speaker. Several switches are positioned about the figure to determine whether the figure is in an upright position or not in an upright position and to determine the positions of the legs relative to the torso and one another. The feedback through the switches to the circuit board enables the figure to walk, run, fall over, and snore depending upon the position of the figure.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
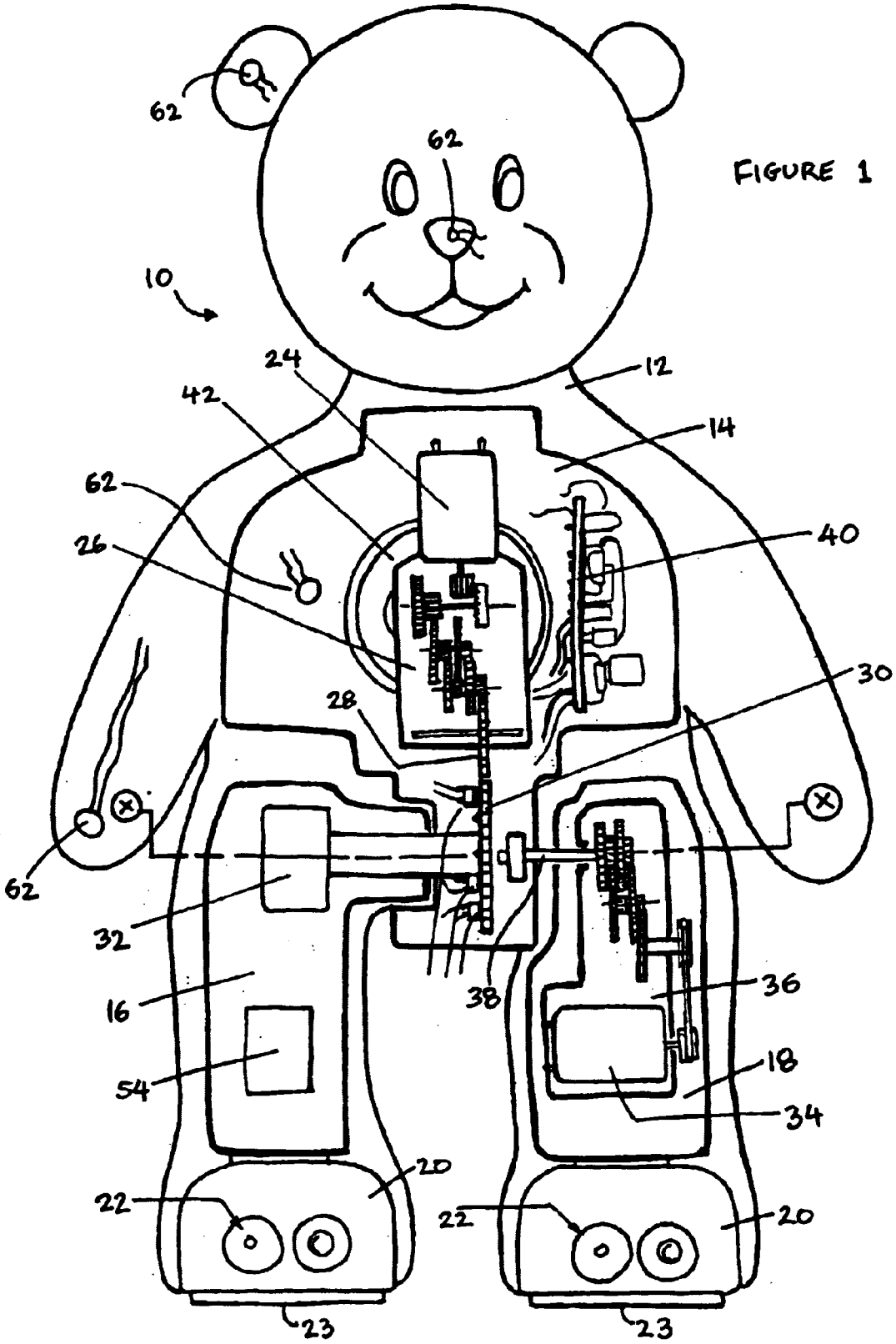
FIG. 1 is front view showing internally the components of a walking toy figure.

While the invention is susceptible to embodiments in many different forms, there are shown in the drawings and will be described herein in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, a FIG. 10 in accordance with the present invention includes an outer covering 12, which is illustrated as a teddy bear. However, the outer covering 12 may be changed to represent any type of animal or character, fictional or real, without changing the scope of the present invention. The FIG. 10 includes an upper torso 14 and a pair of legs 16 and 18 (referred to herein as a first leg 16 and a second leg 18). Attached to each leg is a foot 20 that houses a power supply 22, such as a changeable battery pack.

The upper torso 14 houses a torso motor 24 that drives a torso gear box 26. Meshed to the torso gear box 26 is a first gear 28 that is further meshed to a second gear 30. The second gear 30 is secured to a fastener 32 in the first leg 16. This permits the first leg 16 to move relative to the torso 14 about a common axis x. The second leg 18 includes a leg motor 34 that drives a leg gear box 36. The leg gear box 36 is meshed to an axle 38 (positioned along the axis x) that is rotatably connected to the torso 14, such that when the leg motor 34 is operating, the second leg 18 moves relative to the torso 14 and the first leg 16.

A circuit board 40 is connected to and controls both motors 24 and 34 to synchronize the movement of the FIG. 10. Appropriate phrases or music emanate from a speaker 42 that is in communication with the circuit board 40. The circuit board 40 is also in communication with various switching assemblies, activation switches and the power supplies.

Figure 2:
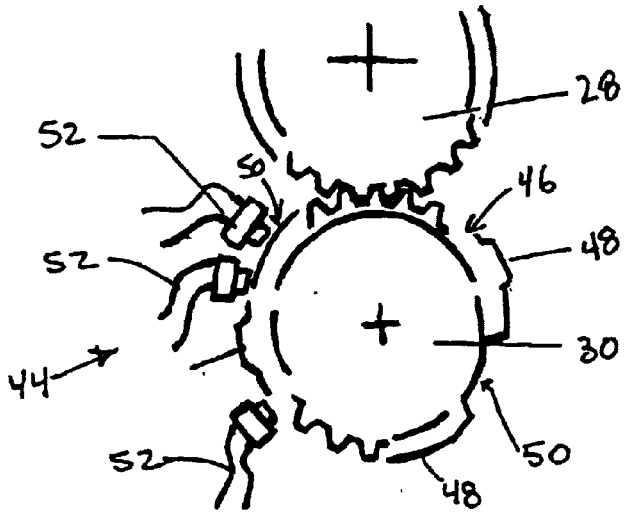
FIG. 2 is a side view illustrating a first gear and a second gear that are positioned between the torso and one of the legs and which include switches that are activated by a cam to indicate the position of the leg relative to the torso.

Also referring to FIG. 2, to determine the position of the legs or orientation of the FIG. 10, a torso switch assembly 44 is mounted in the torso and in communication with the second gear 30. The torso switch assembly 44 indicates to the circuit board 40 the relative position of the first leg 16 to the torso 12. The feedback through the torso switch assembly 44 enables the circuit board 40 to direct the FIG. 10 to walk, run, fall over, and snore (explained in greater detail below in the operation of the FIG. 10). The torso switch assembly 44 includes a cam 46 that is secured to the second gear 30. The cam 46 has a plurality of lobes 48 and contours 50 that move past and activate and deactivate a plurality of switches 52 mounted at specific locations around the cam 46. As the lobes 48 and contours 50 activate and deactivate a switch 52, a signal is sent to the circuit board 40 indicating a position of the first leg 16 in relation to the torso 14. The circuit board 40 can then interpret the signal to determine the position.

Figure 3A:
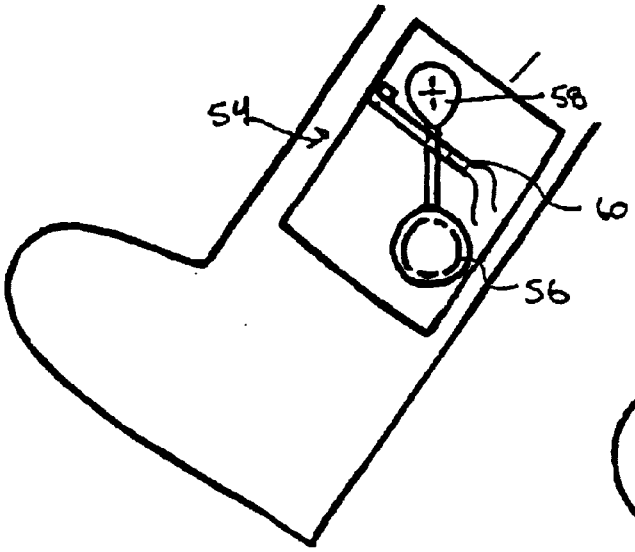
FIGS. 3*a* and 3*b* are side views of the other leg illustrating a position switch to indicate the position of the leg.
Figure 3B:
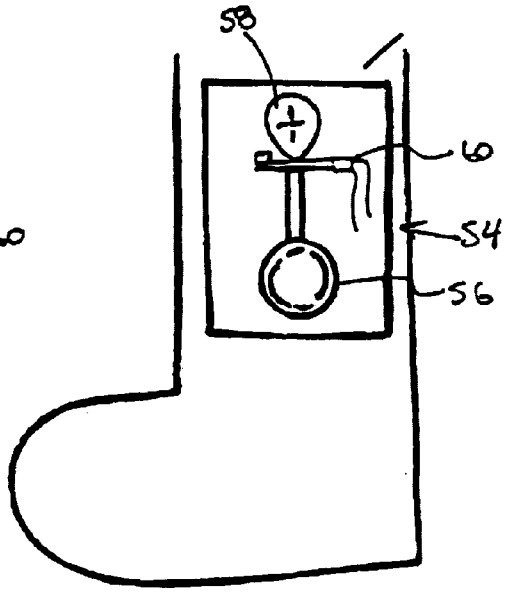

Also referring to FIGS. 3*a* and 3*b*, a leg switch assembly 54 is positioned in the first leg 16 to indicate to the circuit board 40 whether the FIG. 10 is in an upright or inclined position. The leg switch assembly 54 includes a swinging weight 56 attached to a cam 58 that brushes a switch 60 when the leg is inclined. The switch 60 is then activated sending a signal to the circuit board 40. This allows the circuit board 40 to activate a specific set of responses and movements when the FIG. 10 is in an upright position and a different set of responses and movements when the FIG. 10 is not in an upright position, such as a lying down position.

The circuit board 40 controls the speed and relative motion of the motors (either forwards or backwards if the motors are reciprocating motors). The circuit board 40 also stores sets of pre-programmed instructions that define various actions or modes that the FIG. 10 performs. For example, when the circuit board 40 determines the figure is standing, by the receipt of signals from the switch assemblies, the circuit board 40 may run the instructions defined for a walking mode or running mode, which causes the figure to walk or run across a surface. Other modes may be falling down from a standing position, lying down from a sitting position, and kicking its legs in a laying position.

During operation, a user may activate a mode by depressing or squeezing activation switches 62 positioned throughout the figure's body, such as in the figure's hand, ear, nose, tummy, or legs. Once the FIG. 10 is turned on, the switch assemblies send signals to the circuit board 40, which can then determine the position or orientation of the FIG. 10. In other aspects the modes may be activated automatically and/or randomly once the figure has been turned on once.

Figure 4:
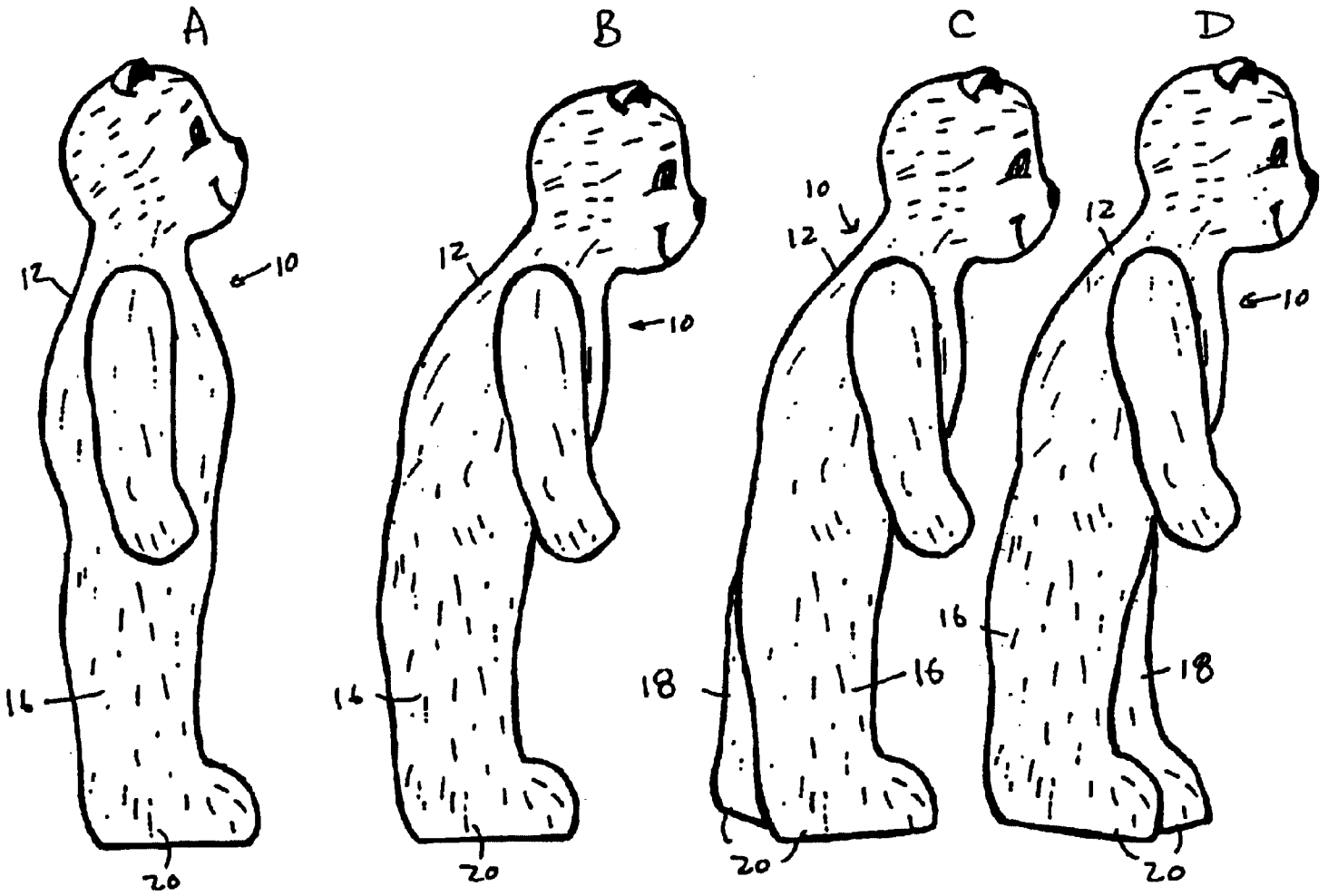
FIG. 4 is a side view of the figure showing in four illustrations the figure bending its torso forwards (A to B), and moving its legs to walk across a surface (C to D)

Referring now to FIG. 4, as mentioned above, the FIG. 10 is capable of walking or running when activated. In order to walk or run, the FIG. 10 bends forward at the waist, this is accomplished by activating the torso motor 24 for a short period of time. Since the FIG. 10 is standing on a surface, the activation of the torso motor 24 will cause the torso 12 to move relative to the first leg 16 or cause the FIG. 10 to bend at the waist. The torso motor 24 is controlled such that the torso 12 moves about 30 degrees from the upright position (FIG. 4, illustration A to B). The weight of the upper half of the FIG. 10 is then displaced forwardly onto the feet 20. This is important because otherwise the FIG. 10 may fall over while walking or running. Next, the leg motor 34,moves the second leg 18 forwards and backwards in relation to the first leg 16. Since the weight of the FIG. 10 is directed forwardly onto the feet 22, as the second leg 18 moves the FIG. 10 will move in a forward direction (FIG. 4, illustrations C to D). In addition, the FIG. 10 includes a directional fabric 23 under the feet 22 that helps in controlling the walking, so the figure is less likely to slip and fall over.

Figure 5:
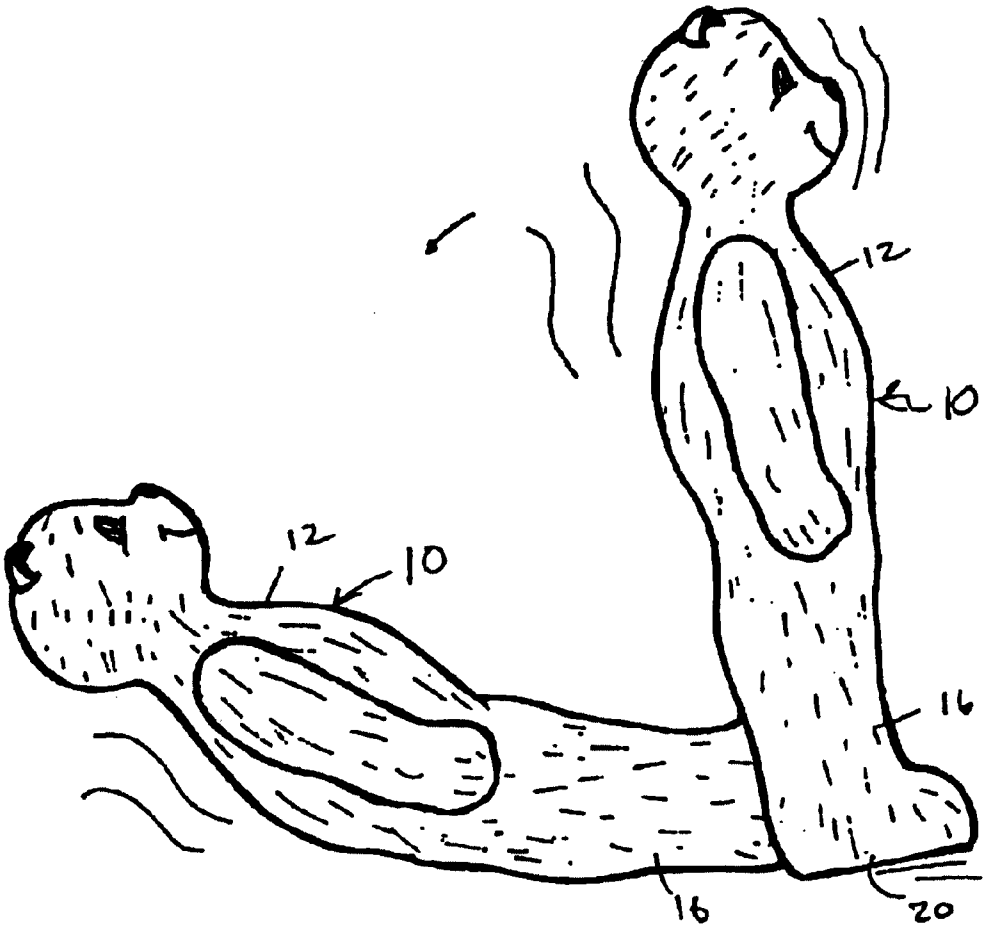
FIG. 5 is a side view of the figure showing the figure wobbling unsteadily and falling to a lying position.

Referring now to FIG. 5, in another mode, if the FIG. 10 is standing, the circuit board 40 may control the torso motor 24 to move the torso 14 backwards making the figure unbalanced and causing the figure to fall down into a lying position. Various sounds can be linked to this activity, such as sneezing.

Figure 6:
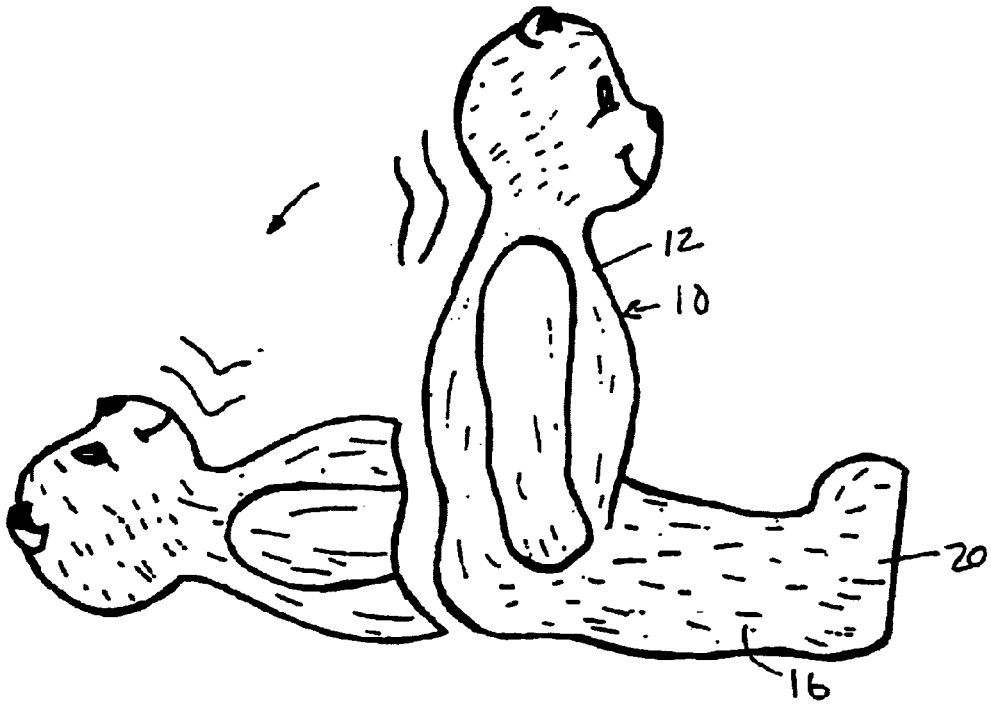
FIG. 6 is a side view of the figure showing the figure moving from a sitting position to a lying down position.
Figure 7:
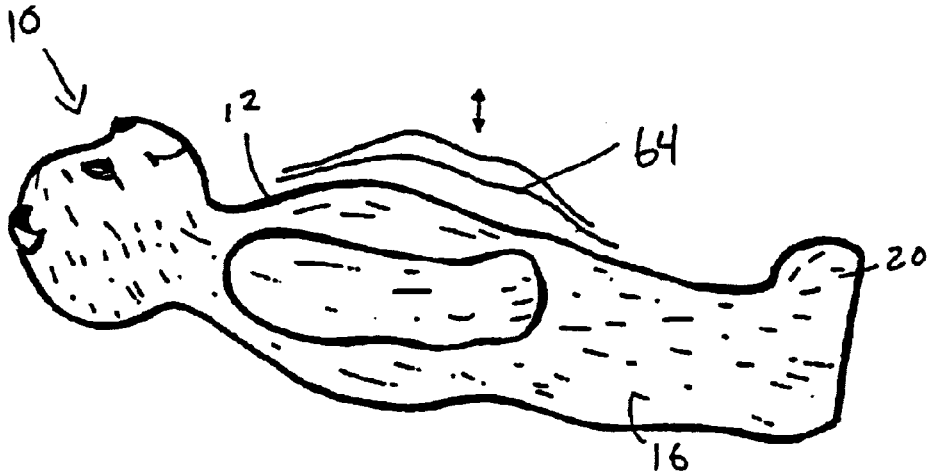
FIG. 7 is a side view of the figure showing the figure's tummy region heaving up and down.

Yet in another mode, if the FIG. 10 was placed in a sitting position by the user, FIG. 6, the circuit board 40 receiving signals from the torso and leg switch assemblies that the FIG. 10 was in a sitting position may say "It is nap time" and recline into a lying down position. From the lying down position, FIG. 7, the circuit board 40 may continue to control the torso motor 24 in a minute reciprocating fashion to move the torso 14 in relation to the legs such that it appears as if the tummy region 64 was heaving up and down. The FIG. 10 may also emanate. snoring noises to simulate the FIG. 10 sleeping.

The specific types of movements are controlled by the circuit board 40 operating the motors 24 and 34 at various rates and speeds.

From the foregoing and as mentioned above, it will be observed that numerous variations and modifications may be effected without departing from the spirit and scope of the novel concept of the invention. It is to be understood that no limitation with respect to the specific methods and/or apparatus illustrated herein is intended or should be inferred. It is, of course, intended to cover by the appended claims all such modifications as fall within the scope of the claims.

We claim:

1. A toy figure having a torso connected to a first leg and a second leg and a foot attached to each of said legs, the figure further comprising:

a first motor secured in the torso and in communication with a first gear train that is also secured in the torso, the first gear train is further meshed to a fastener in the first leg, wherein when the figure is in a standing position on a surface, the first motor causes the torso to move in relation to the first leg along an axis;

a second motor secured in the second leg and in communication with a second gear train that is also secured in the second leg, the second gear train is rotatably attached to the torso such that when the figure is in the standing position, the second motor causes the second leg to move in relation to the first leg along the axis;

a circuit board in communication with a power supply and the first and second motors, the circuit board having pre-programmed instructions defining a walking mode, wherein when the figure is in the standing position and the circuit board is activated, the circuit board controls the first motor such, that the torso tilts downwardly towards the first leg by a predetermined angle and controls the second motor to move the second leg backwards and forwards repeatedly at a predetermined speed such that the figure walks across the surface; and a means to activate the circuit board.

2. The figure of claim 1, wherein the predetermined angle is approximately 30 degrees from an upright orientation.

3. The figure of claim 1 further comprising a plurality of sensors in communication with the circuit board and positioned about a cam that moves relative to the movement of the torso and the first leg, the cam includes a plurality of lobes and contours that activate the sensors to indicate to the circuit board a position of the first leg in relation to the torso.

4. The figure of claim 3 further comprising an orientation sensor positioned in the first leg and in communication with the circuit board, the orientation sensor indicates to the circuit board an orientation of the first leg such that the circuit board is capable of determining an orientation of the figure.

5. The figure of claim 1, wherein the circuit board includes pre-programmed instructions to increase and decrease the predetermined speed of the second motor such that the circuit board has pre-programmed instructions defining a running mode and the circuit board can alternate between said running mode and the walking mode.

6. The figure of claim 1 further comprising a speaker in communication with the circuit board and the power supply to emit sounds.

7. The figure of claim 1, wherein when the figure is in a lying position on a surface, the first motor causes the first leg to move in relation to the torso.

8. The figure of claim 1, wherein the means to activate the circuit board includes a plurality of switches separately positioned about the figure.

9. A toy figure comprising:

a torso having a first leg, a second leg and a first motor in communication with a first gear train, the first gear train is a secured to said first leg such that the first motor is capable of moving said leg in relation to the torso;

a second motor in communication with said second gear train is secured in a second leg that is rotatably secured to the torso such that the second motor is capable of moving said second leg in relation to the first leg;

a circuit board in communication with a power supply and the first and second motors, the circuit board having a plurality of sets of pre-programmed instructions to control the motors, wherein each set of pre-programmed instructions defines an action mode that when activated cause the figure to move in a predetermined fashion; and a means to activate the circuit board.

10. The figure of claim 9 further comprising:

a plurality of sensors separately secured to the torso and the first leg, the sensors in communication with the circuit board to indicate a position of the first leg in relation to the torso and to indicate an orientation of the figure.

11. The figure of claim 9, wherein one of the action modes is further defined as a walking mode that when activated controls the first and second motors such that the torso moves towards the first leg a predetermined amount and the second leg moves backwards and forwards, whereby the movement of the torso displaces the weight of the figure such that when the second leg moves the figure walks across a surface.

12. The figure of claim 11, wherein a speed of the second motor is increased by the circuit board to define a running mode.

* * * * *